US010337436B2

(12) United States Patent
Jammoussi et al.

(10) Patent No.: US 10,337,436 B2
(45) Date of Patent: Jul. 2, 2019

(54) EXHAUST GAS SENSOR CONTROLS ADAPTATION FOR ASYMMETRIC TYPE SENSOR DEGRADATION

(71) Applicant: Ford Global Technologies, LLC, Dearborn, MI (US)

(72) Inventors: Hassene Jammoussi, Canton, MI (US); Imad Hassan Makki, Dearborn Heights, MI (US); Gladys G. Galicia, Shelby Township, MI (US); Kenneth John Behr, Farmington Hills, MI (US); Zena Yanqing Yee, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/804,288

(22) Filed: Nov. 6, 2017

(65) Prior Publication Data

US 2019/0136780 A1 May 9, 2019

(51) Int. Cl.

| | |
|---|---|
| ***F02D 41/14*** | (2006.01) |
| ***F02D 41/30*** | (2006.01) |
| *F02D 41/26* | (2006.01) |

(52) U.S. Cl.

CPC ..... *F02D 41/1495* (2013.01); *F02D 41/1401* (2013.01); *F02D 41/1454* (2013.01); *F02D 41/3005* (2013.01); *F02D 41/26* (2013.01)

(58) Field of Classification Search

CPC ..... F02D 41/1495; F02D 41/1401; F02D 41/1454; F02D 41/3005; F02D 41/26

See application file for complete search history.

(56) References Cited

U.S. PATENT DOCUMENTS

| | | | | |
|---|---|---|---|---|
| 8,924,130 | B2 | 12/2014 | Uhrich et al. | |
| 8,958,974 | B2 | 2/2015 | Makki et al. | |
| 9,074,513 | B2 | 7/2015 | Makki et al. | |
| 9,169,795 | B2 | 10/2015 | Jammoussi et al. | |
| 9,249,751 | B2 | 2/2016 | Jammoussi et al. | |
| 9,416,714 | B2 | 8/2016 | Uhrich et al. | |
| 2007/0051092 | A1* | 3/2007 | Pallett | F01N 11/002 60/276 |
| 2013/0180510 | A1* | 7/2013 | Makki | F02D 41/1495 123/672 |
| 2013/0231844 | A1* | 9/2013 | Uhrich | F01N 11/007 701/104 |
| 2013/0231847 | A1* | 9/2013 | Uhrich | F01N 11/00 701/108 |
| 2014/0229089 | A1* | 8/2014 | Jankovic | F02D 41/30 701/104 |

(Continued)

*Primary Examiner* — Thomas N Moulis

(74) *Attorney, Agent, or Firm* — Julia Voutyras; McCoy Russell LLP

(57) ABSTRACT

Methods and systems are provided for converting an asymmetric sensor response of an exhaust gas sensor to a symmetric response. In one example, a method includes adjusting fuel injection responsive to a modified exhaust oxygen feedback signal from an exhaust gas sensor, where the modified exhaust oxygen feedback signal is modified by transforming an asymmetric response of the exhaust gas sensor to a symmetric response. Further, the method may include adapting parameters of an anticipatory controller of the exhaust gas sensor based on the modified symmetric response.

19 Claims, 8 Drawing Sheets

(56) References Cited

U.S. PATENT DOCUMENTS

2014/0345584 A1* 11/2014 Jammoussi ..... F02D 41/30
123/672
2015/0046063 A1* 2/2015 Jammoussi ..... F02D 41/1495
701/103

* cited by examiner

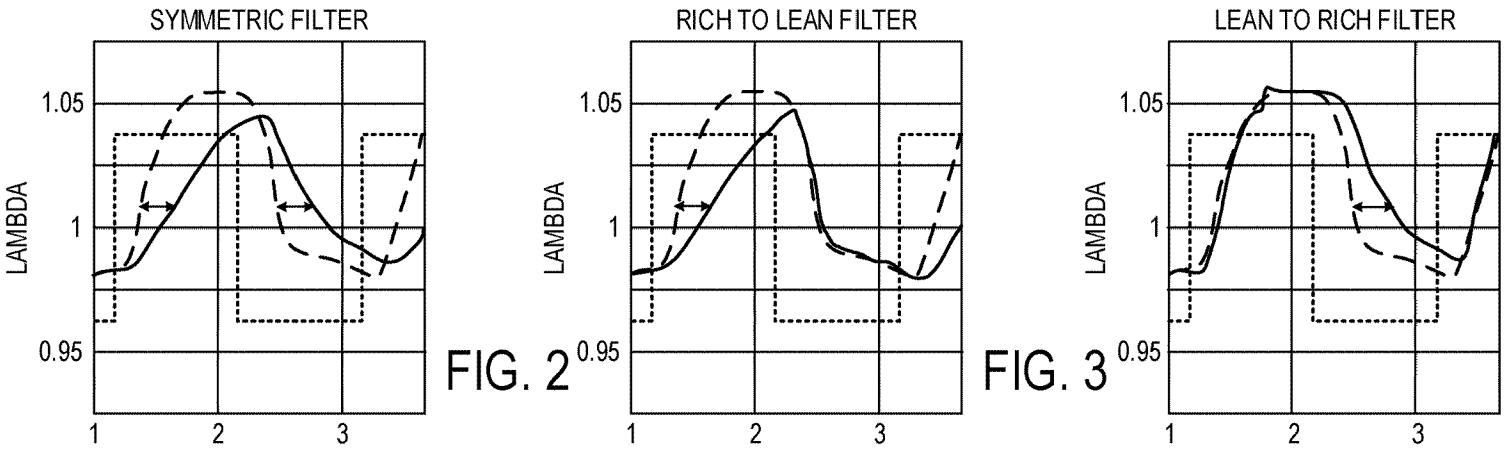
FIG. 2
FIG. 3
FIG. 4
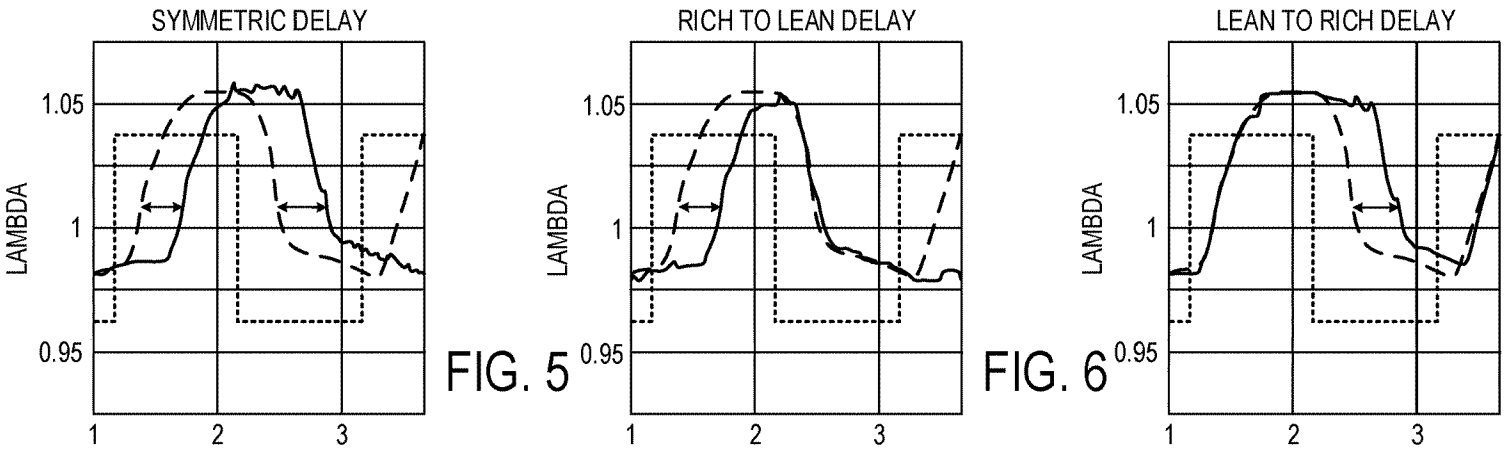
FIG. 5
FIG. 6
FIG. 7
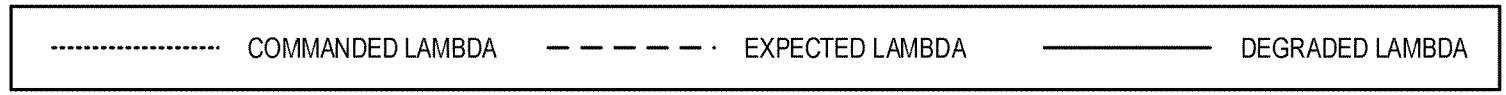

EXHAUST GAS SENSOR CONTROLS ADAPTATION FOR ASYMMETRIC TYPE SENSOR DEGRADATION

FIELD

The present description relates generally to methods and systems for controlling air-fuel ratio of an internal combustion engine based on modified responses from an exhaust gas sensor with asymmetric type sensor degradation.

BACKGROUND/SUMMARY

An exhaust gas sensor may be positioned in an exhaust system of a vehicle for detecting an air-fuel ratio of the gas exhausted from an internal combustion engine. For example, the exhaust gas sensor readings may feedback to a controller for adjusting the air-fuel ratio of the engine by modifying the amount of fuel injector from a fuel injector of the engine.

Degradation of the exhaust gas sensor may cause engine control degradation resulting in increased emissions and/or reduced vehicle drivability. In particular, an exhaust gas sensor may exhibit numerous discrete types of degradation. The sensor degradation types may be grouped into filter type degradation and delay type degradation. Further, the sensor degradation types may either be symmetric or asymmetric. For example, a sensor with asymmetric type sensor degradation may have different response dynamics (such as response time or response rate) when the sensor response increases versus when the sensor output decreases.

Previous approaches for addressing the sensor degradation includes equipping the exhaust gas sensor with an anticipatory controller for correcting or compensating for the degradation. For example, parameters of the anticipatory controller may be adjusted based on the type of sensor degradation. Further, to maintain stability of the anticipatory controller system, gains of the feedback control routine of the controller, such as a proportional/integral control routine, may be reduced aggressively to reduce system instability.

However, the inventors herein have recognized potential issues with such systems. For example, adjusting parameters of the anticipatory controller may not address the asymmetric dynamics of the sensor response during rich-to-lean and lean-to-rich transitions. This may result in asymmetric engine operation when a commanded air-fuel ratio transitions in different directions (e.g. the rich-to-lean direction and the lean-to-rich direction). As a result, more or less fuel may be delivered in the direction of the degradation, and CO or NOx emission may be increased.

In one example, the issues described above may be addressed by a method comprising sensing an air-fuel ratio via an exhaust gas sensor; responsive to an asymmetric sensor response, generating a modified air-fuel ratio with a symmetric response based on the sensed air-fuel ratio; and adjusting fuel injection based on the modified air-fuel ratio. In this way, the anticipatory controller may compensate the sensor degradation similarly when the commanded air-fuel ratio transits in both the rich-to-lean and lean-to-rich directions, and the asymmetric engine operation may be reduced.

As one example, a method may comprise operating an engine with a commanded air-fuel ratio, and determining the type and magnitude of sensor degradation by comparing the sensed air-fuel ratio with a commanded air-fuel ratio. The exhaust gas sensor may be determined to have asymmetric type sensor degradation when a response rate and/or a response time of the sensor response is different responsive to the commanded air-fuel ratio transitioning in different directions (e.g., rich-to-lean direction or lean-to-rich direction). The exhaust gas sensor may exhibit symmetric type sensor degradation if the response rate and response time are the same responsive to the commanded air-fuel ratio transitioning in different directions, while the response rate or the response time is different from an expected value. Responsive to the asymmetric type sensor degradation, a modified sensor response may be generated by introducing a lower response rate and increased response time (e.g., modifying the sensor reading to be symmetric) as compared to the un-faulted portion of the sensed air-fuel ratio. As such, the modified sensor response may have the same response rate and/or the response time when the commanded air-fuel ratio transitions in each of the increasing and decreasing directions. As such, the modified sensor response is more symmetric comparing to the sensed air-fuel ratio. The modified sensor response may then be fed to an anticipatory controller with parameters adapted based on the sensor degradation. In this way, the anticipatory controller may operate more symmetrically and effectively to address sensor degradation during both rich-to-lean and lean-to-rich transitions. Further, calibration work of the controller may be reduced, and NOx and CO emissions of the engine may be reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows a graph indicating a symmetric filter type sensor degradation of an exhaust gas sensor.

FIG. 3 shows a graph indicating an asymmetric rich-to-lean filter type sensor degradation of an exhaust gas sensor.

FIG. 4 shows a graph indicating an asymmetric lean-to-rich filter type sensor degradation of an exhaust gas sensor.

FIG. 5 show a graph indicating a symmetric delay type sensor degradation of an exhaust gas sensor.

FIG. 6 shows a graph indicating an asymmetric rich-to-lean delay type sensor degradation of an exhaust gas sensor.

FIG. 7 shows a graph indicating an asymmetric lean-to-rich delay type sensor degradation of an exhaust gas sensor.

DETAILED DESCRIPTION

Figure 1:
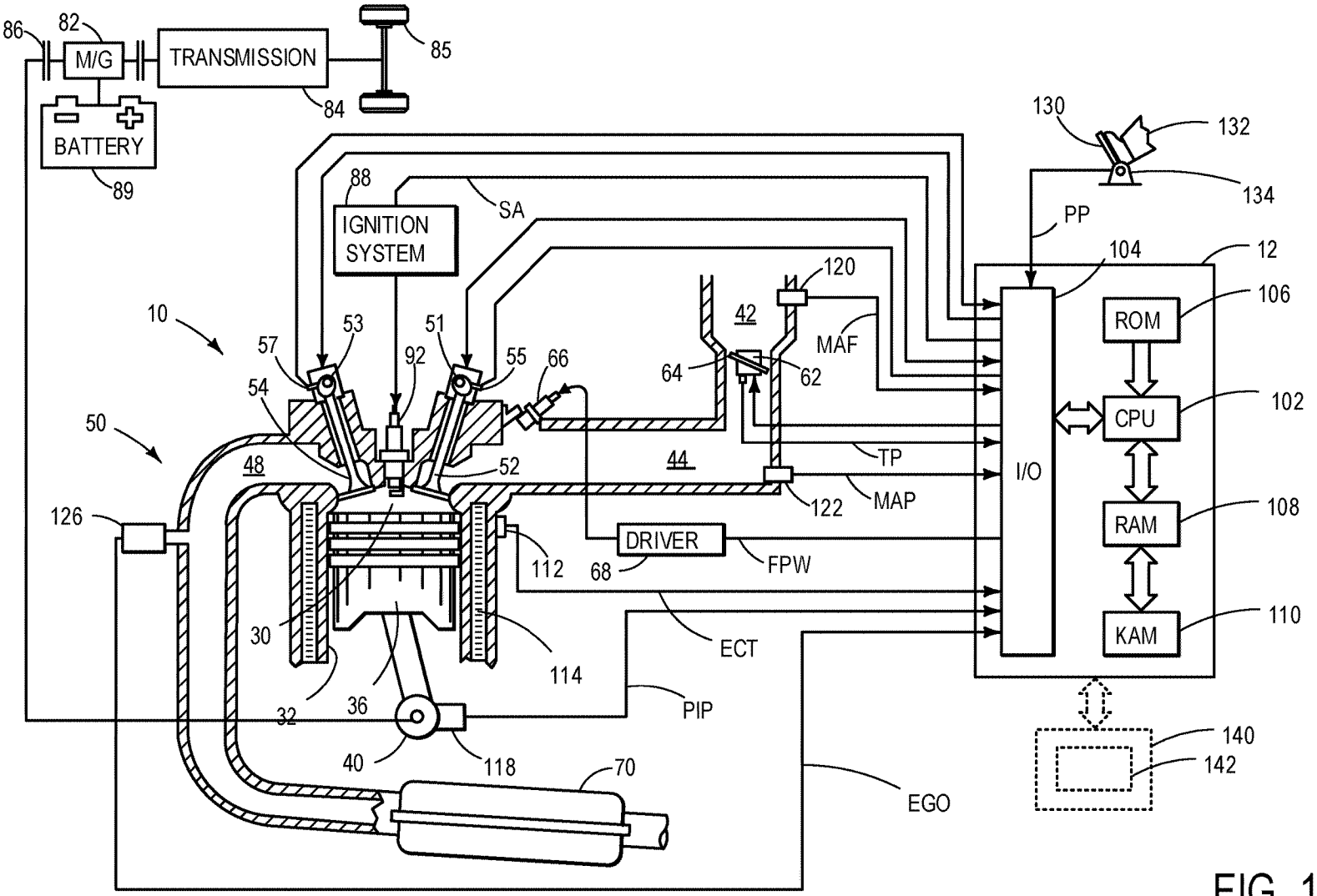
FIG. 1 shows a schematic diagram of an embodiment of an engine system of a vehicle including an exhaust gas sensor.
Figure 8:
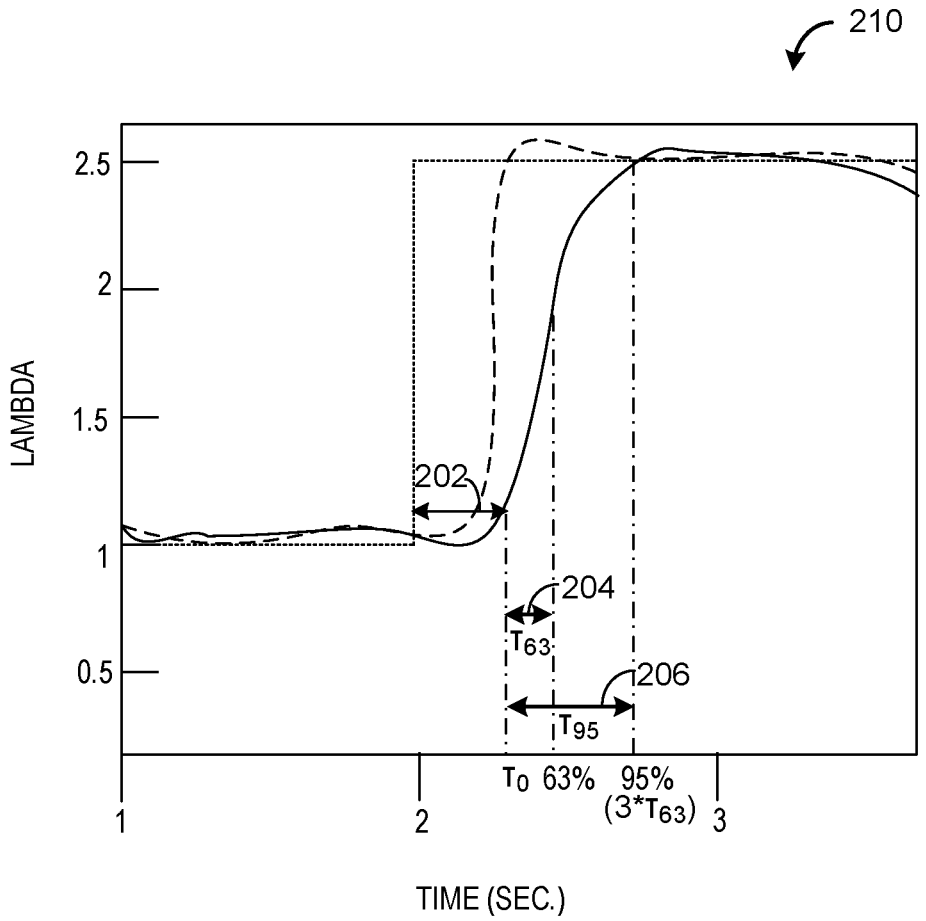
FIG. 8 shows a graph of an example response of a degraded exhaust gas sensor to a commanded air-fuel ratio.
Figure 9:
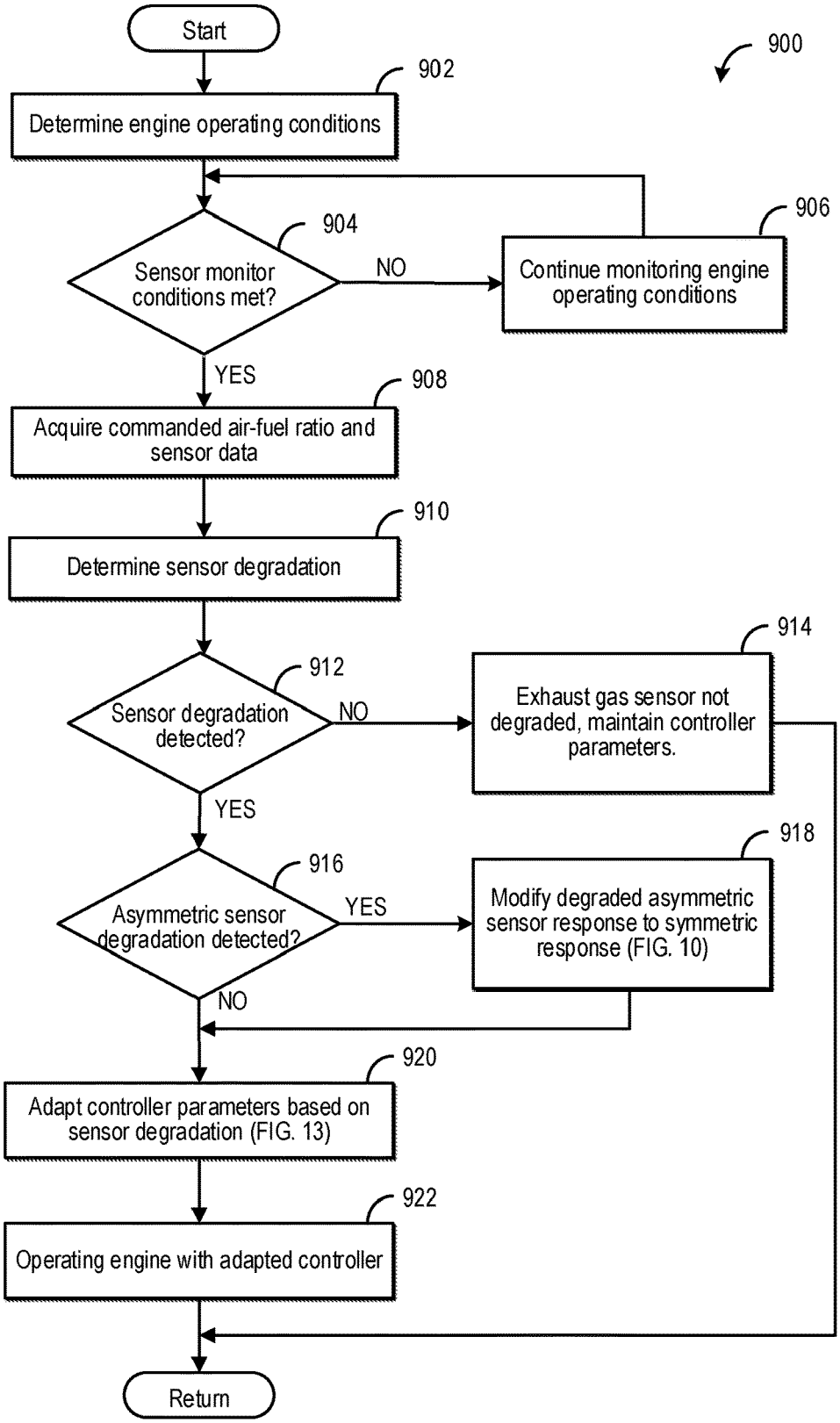
FIG. 9 shows a high level flow chart of an example method of controlling engine air-fuel ratio.
Figure 10:
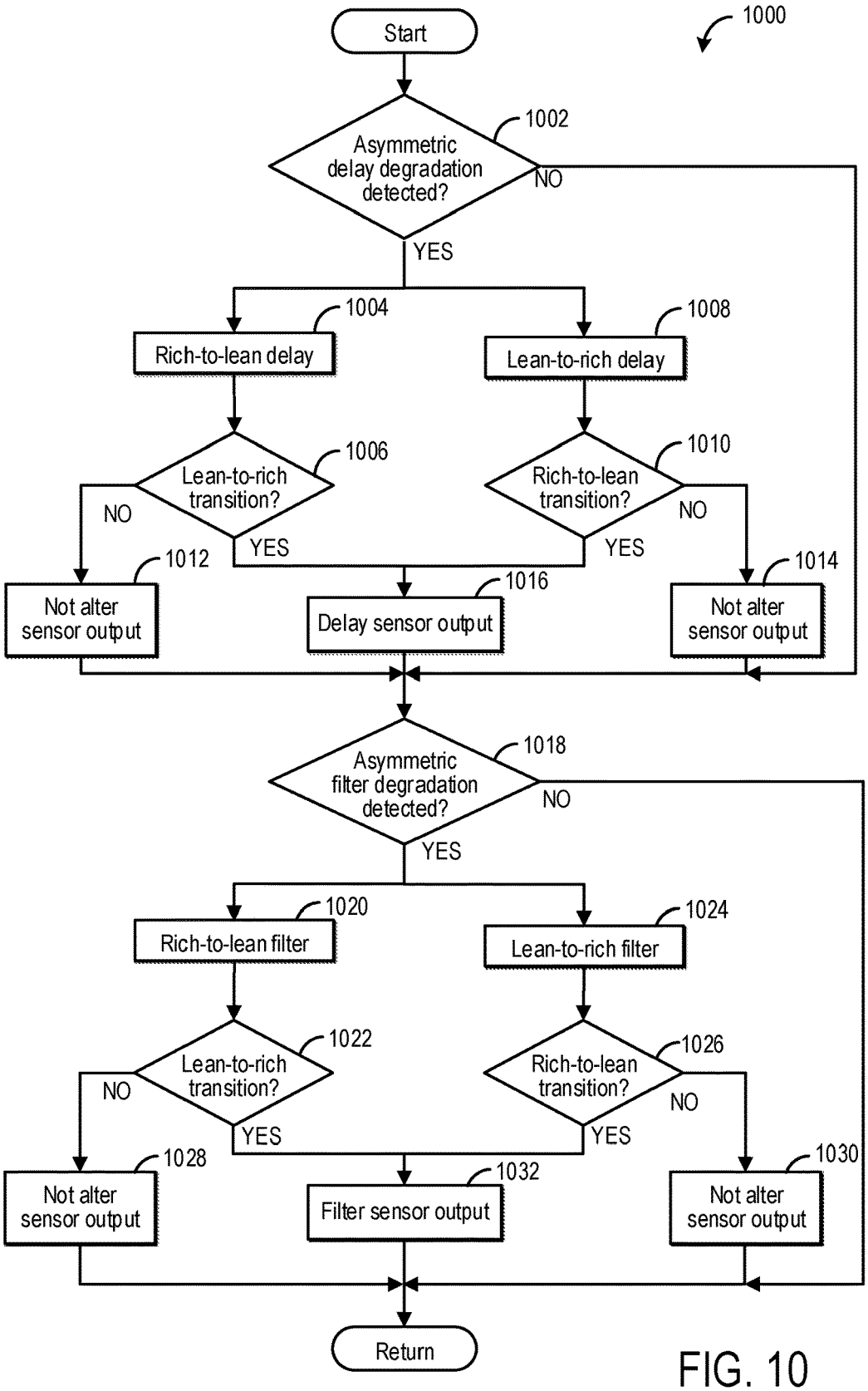
FIG. 10 shows an example method for converting sensor response with asymmetric type degradation to a symmetric response.
Figure 11:
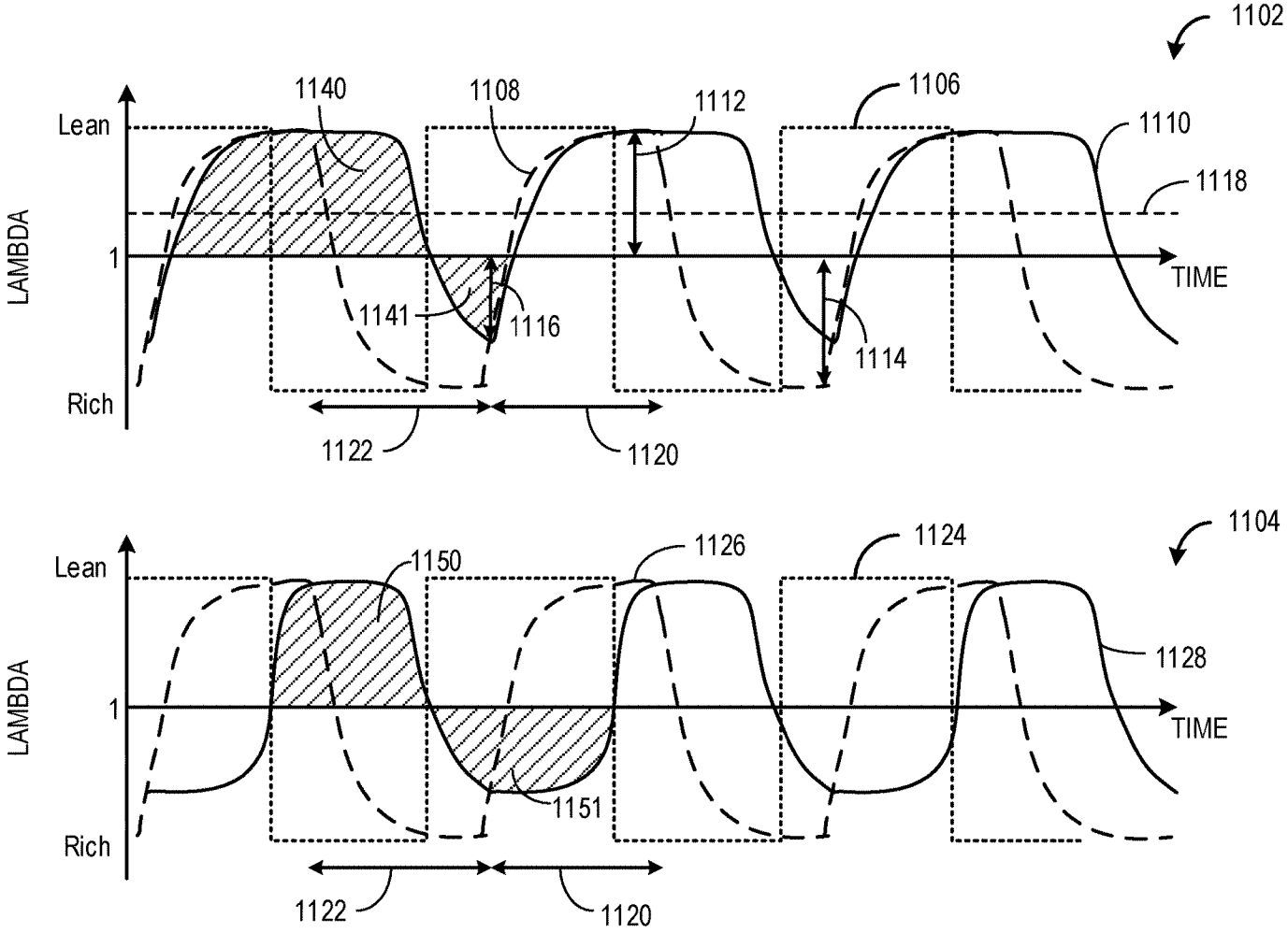
FIG. 11 shows an example of modified sensor response transformed from an asymmetric rich-to-lean delay sensor response.
Figure 12:
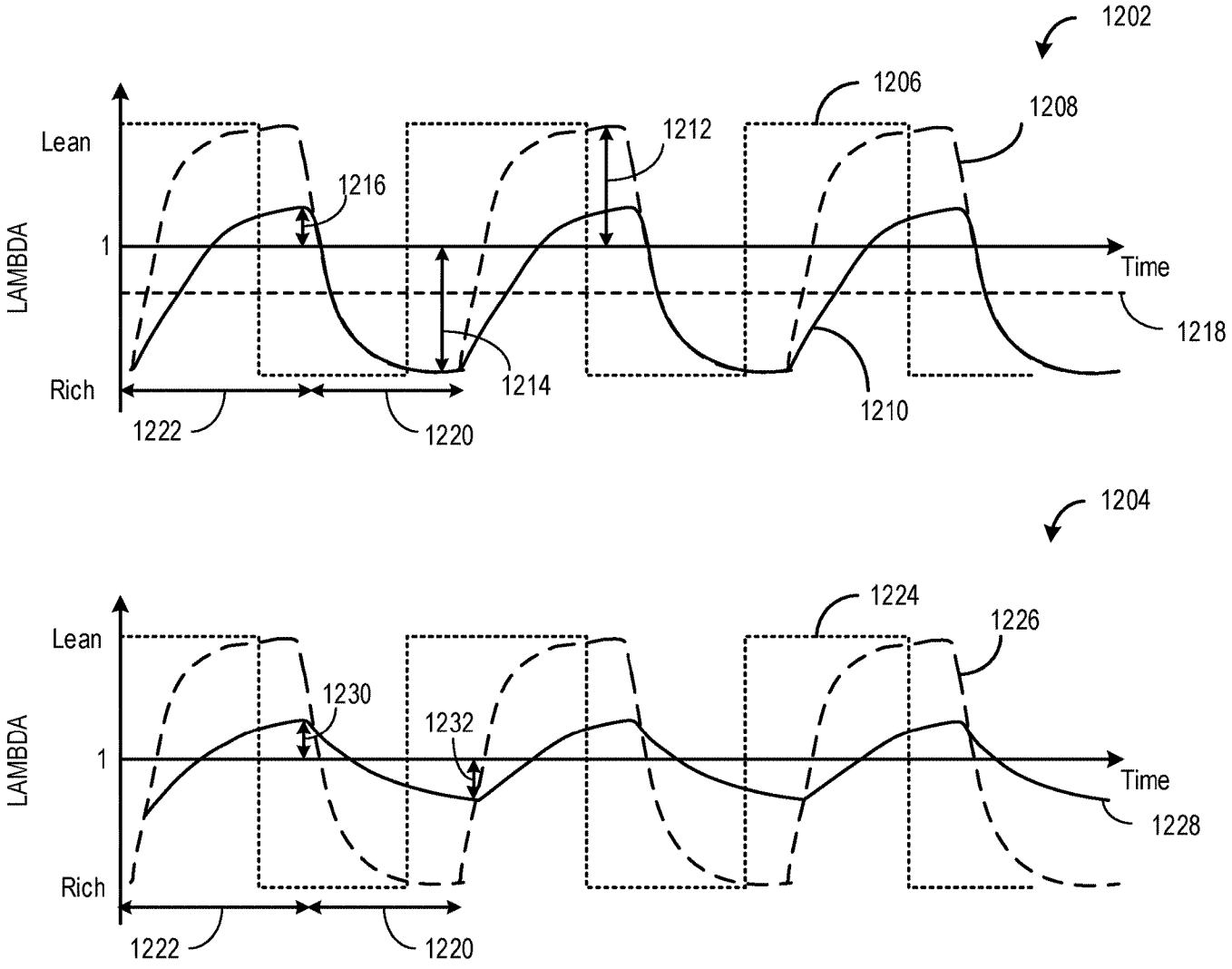
FIG. 12 shows an example of modified sensor response transformed from an asymmetric rich-to-lean filter sensor response.
Figure 13:
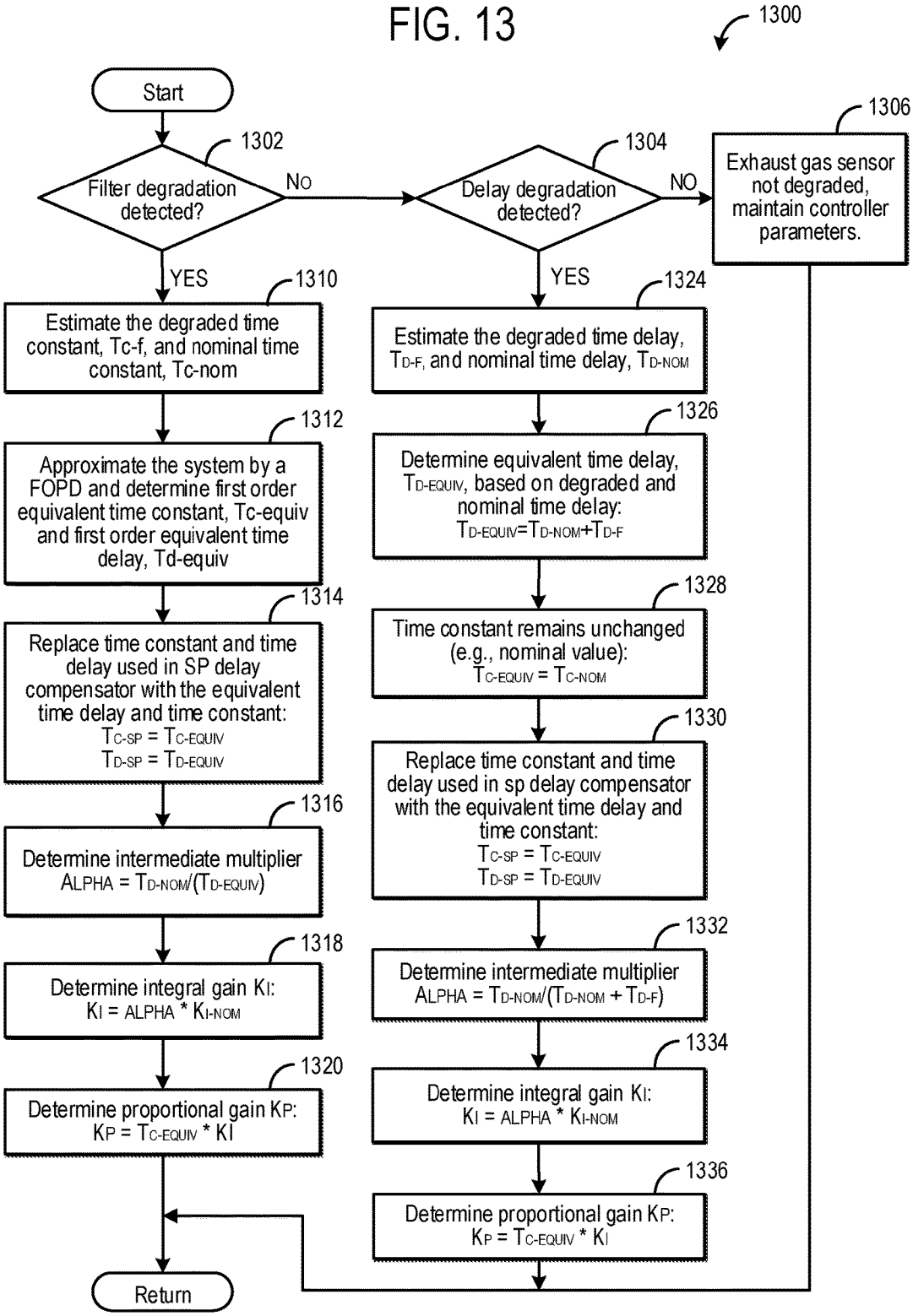
FIG. 13 is a flow chart illustrating a method for adapting parameters of the PI controller and the anticipatory controller.

The following description relates to systems and methods for controlling air-fuel ratio entering a cylinder of an internal combustion engine based on feedback from an exhaust gas sensor. In particular, the method includes adjusting fuel injection to compensate for asymmetric responses from a degraded exhaust gas sensor. FIG. 1 shows one example embodiment of an engine system equipped with an exhaust gas sensor. The sensor may exhibit six types of degradation illustrated in FIGS. 2-7. The degradation may be categorized as symmetric type of sensor degradation (FIG. 2 and FIG. 5) and asymmetric type of sensor degradation (FIGS. 3-4 and FIGS. 6-7). The asymmetric type sensor degradation may lead to asymmetric engine operation responsive to the commanding the air-fuel ratio transiting in different directions (e.g. the lean-to-rich direction and the rich-to-lean direction). Sensor with asymmetric type degradation has different response dynamics when the sensed signal transitions in different directions. The dynamics of sensor response may be quantified with parameters such as time delay, time constant, and line length as shown in FIG. 8. FIG. 9 shows an example method for air-fuel control. The method includes modifying sensor response and parameters of an exhaust gas sensor controller based on the type and magnitude of sensor degradation, and controlling fuel injection based on the modified sensor response via the modified exhaust gas sensor controller. FIG. 10 shows a low level flow chart for modifying asymmetric sensor response to a symmetric response. FIG. 11 and FIG. 12 are examples of sensed air-fuel ratio and modified air-fuel ratio in the asymmetric delay type sensor degradation and the asymmetric filter type sensor degradation, respectively. FIG. 13 shows procedures for adapting parameters of the exhaust gas sensor controller based on the sensor degradation.

FIG. 1 is a schematic diagram showing one cylinder of multi-cylinder engine 10, which may be included in a propulsion system of a vehicle in which an exhaust gas sensor 126 may be utilized to determine an air-fuel ratio of exhaust gas produced by engine 10. The air-fuel ratio (along with other operating parameters) may be used for feedback control of engine 10 in various modes of operation. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 44 via intake passage 42 and may exhaust combustion gases via exhaust passage 48. A throttle 62 including a throttle plate 64 may be provided between the intake manifold 44 and the intake passage 42 for varying the flow rate and/or pressure of intake air provided to the engine cylinders. Adjusting a position of the throttle plate 64 may increase or decrease the opening of the throttle 62, thereby changing mass air flow, or the flow rate of intake air entering the engine cylinders. For example, by increasing the opening of the throttle 62, mass air flow may increase. Conversely, by decreasing the opening of the throttle 62, mass air flow may decrease. In this way, adjusting the throttle 62 may adjust the amount of air entering the combustion chamber 30 for combustion. For example, by increase mass air flow, torque output of the engine may increase.

Intake manifold 44 and exhaust passage 48 can selectively communicate with combustion chamber 30 via respective intake valve 52 and exhaust valve 54. In some embodiments, combustion chamber 30 may include two or more intake valves and/or two or more exhaust valves. In this example, intake valve 52 and exhaust valves 54 may be controlled by cam actuation via respective cam actuation systems 51 and 53. Cam actuation systems 51 and 53 may each include one or more cams and may utilize one or more of cam profile switching (CPS), variable cam timing (VCT), variable valve timing (VVT) and/or variable valve lift (VVL) systems that may be operated by controller 12 to vary valve operation. The position of intake valve 52 and exhaust valve 54 may be determined by position sensors 55 and 57, respectively. In alternative embodiments, intake valve 52 and/or exhaust valve 54 may be controlled by electric valve actuation. For example, cylinder 30 may alternatively include an intake valve controlled via electric valve actuation and an exhaust valve controlled via cam actuation including CPS and/or VCT systems.

Fuel injector 66 is shown arranged in intake manifold 44 in a configuration that provides what is known as port injection of fuel into the intake port upstream of combustion chamber 30. Fuel injector 66 may inject fuel in proportion to the pulse width of signal FPW received from controller 12 via electronic driver 68. Fuel may be delivered to fuel injector 66 by a fuel system (not shown) including a fuel tank, a fuel pump, and a fuel rail. In some embodiments, combustion chamber 30 may alternatively or additionally include a fuel injector coupled directly to combustion chamber 30 for injecting fuel directly therein, in a manner known as direct injection.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or one or more other combustion chambers of engine 10 may be operated in a compression ignition mode, with or without an ignition spark.

Exhaust gas sensor 126 is shown coupled to exhaust passage 48 of exhaust system 50 upstream of emission control device 70. Exhaust gas sensor 126 may be any suitable sensor for providing an indication of exhaust gas air-fuel ratio such as a linear oxygen sensor or UEGO (universal or wide-range exhaust gas oxygen), a two-state oxygen sensor or EGO, a HEGO (heated EGO), a NOx, HC, or CO sensor. In some embodiments, exhaust gas sensor 126 may be a first one of a plurality of exhaust gas sensors positioned in the exhaust system. For example, additional exhaust gas sensors may be positioned downstream of emission control device 70.

Emission control device 70 is shown arranged along exhaust passage 48 downstream of exhaust gas sensor 126. Emission control device 70 may be a three way catalyst (TWC), NOx trap, various other emission control devices, or combinations thereof. In some embodiments, emission control device 70 may be a first one of a plurality of emission control devices positioned in the exhaust system. In some embodiments, during operation of engine 10, emission control device 70 may be periodically reset by operating at least one cylinder of the engine within a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft.

Furthermore, at least some of the above described signals may be used in various exhaust gas sensor degradation determination methods, described in further detail below. For example, the inverse of the engine speed may be used to determine delays associated with the injection-intake-compression-expansion-exhaust cycle. As another example, the inverse of the velocity (or the inverse of the MAF signal) may be used to determine a delay associated with travel of the exhaust gas from the exhaust valve 54 to exhaust gas sensor 126. The above described examples along with other use of engine sensor signals may be used to determine the time delay between a change in the commanded air-fuel ratio and the exhaust gas sensor response rate.

The controller 12 receives signals from the various sensors of FIG. 1 and employs the various actuators of FIG. 1 to adjust engine operation based on the received signals and instructions stored on a memory of the controller 12. For example, adjusting engine air intake may include adjusting an actuator of throttle plate 64 to adjust the amount of air flowing into the engine cylinder. Adjusting fuel injection may include adjusting the fuel injector by adjusting the FPW signal to control the amount of fuel entering the engine cylinder.

In some embodiments, exhaust gas sensor degradation determination and calibration may be performed in a dedicated controller 140. Dedicated controller 140 may include processing resources 142 to handle signal-processing associated with production, calibration, and validation of the degradation determination of exhaust gas sensor 126. In particular, a sample buffer (e.g., generating approximately 100 samples per second per engine bank) utilized to record the response rate of the exhaust gas sensor may be too large for the processing resources of a powertrain control module (PCM) of the vehicle. Accordingly, dedicated controller 140 may be operatively coupled with controller 12 to perform the exhaust gas sensor degradation determination. Note that dedicated controller 140 may receive engine parameter signals from controller 12 and may send engine control signals and degradation determination information among other communications to controller 12. In another embodiment, the exhaust gas sensor degradation determination and calibration may be performed in controller 12.

In one example, the air-fuel ratio may be controlled via an air-fuel controller including an anticipatory controller and a feedback control routine, such as a proportional/integral (PI) controller. The anticipatory controller may be used for compensating the sensor degradation. The anticipatory controller may include a Smith Predictor. The Smith Predictor may include a time constant, $T_{C\text{-}SP}$, and time delay, $T_{D\text{-}SP}$. The PI controller may include a proportional gain, $K_P$, and an integral gain, $K_I$. In response to degradation of the exhaust gas sensor, the controller parameters listed above may be adjusted to compensate for the degradation and increase the accuracy of air-fuel ratio readings, thereby increasing engine control and performance. The dedicated controller 140 may be communicably coupled to the anticipatory controller. As such, the dedicated controller 140 and/or controller 12 may adjust the parameters of the anticipatory controller based on the type of degradation determined using any of the available diagnostic methods. In another embodiment, the anticipatory controller may be realized in dedicated controller 140. In yet another embodiment, the anticipatory controller may be realized in controller 12. The PI controller may be realized in controller 12. In one example, the exhaust gas sensor controller parameters may be adjusted based on the magnitude and type of the sensor degradation. In another example, the dedicated controller 140 and/or controller 12 may determine the type of the degradation, transform or modify a signal sensed from the exhaust gas sensor with asymmetric sensor degradation, and then feed or input the transformed or modified signal to the exhaust gas sensor controller with adjusted controller parameters. Six types of degradation behaviors are discussed below with reference to FIGS. 2-7. Further details on adjusting the gains, time constant, and time delay of the exhaust gas sensor controller, as well as modifying a degraded response of the exhaust gas sensor, are presented below with reference to FIGS. 9-12.

Note storage medium read-only memory chip 106 and/or processing resources 142 can be programmed with computer readable data representing instructions executable by processor 102 and/or dedicated controller 140 for performing the methods described below as well as other variants.

In some examples, engine system 10 may be included in a hybrid vehicle with multiple sources of torque available to one or more vehicle wheels 85. In other examples, the vehicle is a conventional vehicle with only an engine, or an electric vehicle with only electric machine(s). In the example shown, the vehicle includes engine 10 and an electric machine 82. Electric machine 82 may be a motor or a motor/generator. Crankshaft 140 of engine 10 and electric machine 82 are connected via a transmission 84 to vehicle wheels 85 when one or more clutches 86 are engaged. In the depicted example, a first clutch 86 is provided between crankshaft 140 and electric machine 82, and a second clutch 86 is provided between electric machine 82 and transmission 84. Controller 12 may send a signal to an actuator of each clutch 86 to engage or disengage the clutch, so as to connect or disconnect crankshaft 140 from electric machine 82 and the components connected thereto, and/or connect or disconnect electric machine 82 from transmission 84 and the components connected thereto. Transmission 84 may be a gearbox, a planetary gear system, or another type of transmission. The powertrain may be configured in various manners including as a parallel, a series, or a series-parallel hybrid vehicle.

Electric machine 82 receives electrical power from a traction battery 89 to provide torque to vehicle wheels 85. Electric machine 82 may also be operated as a generator to provide electrical power to charge battery 89, for example during a braking operation.

As discussed above, exhaust gas sensor degradation may be determined based on any one, or in some examples each, of six discrete behaviors characterized by time delays and the response rate of air-fuel ratio readings generated by an exhaust gas sensor responsive to an commanded air-fuel ratio signal during rich-to-lean transitions and/or lean-to-rich transitions. FIGS. 2-7 each show a graph indicating one of the six discrete types of exhaust gas sensor degradation. That is, symmetric filter type sensor degradation (FIG. 2), rich-to-lean filter type sensor degradation (FIG. 3), lean-to-rich filter type sensor degradation (FIG. 4), symmetric delay type sensor degradation (FIG. 5), rich-to-lean delay type sensor degradation (FIG. 6), and lean-to-rich delay type sensor degradation (FIG. 7). Among them, rich-to-lean filter type sensor degradation, lean-to-rich filter type sensor degradation, rich-to-lean delay type sensor degradation, and lean-to-rich delay type sensor degradation are asymmetric type sensor degradations. The graphs plot air-fuel ratio (lambda) versus time (in seconds). The air-fuel ratio increases as indicated with the arrow. In each graph, the dotted line indicates a commanded lambda signal that may be sent to engine components (e.g., fuel injectors, cylinder valves, throttle, spark plug, etc.) from the controller (such as controller 12) to generate an air-fuel ratio that progresses through a cycle comprising one or more lean-to-rich transitions and one or more rich-to-lean transitions. The dashed line indicates an expected lambda response of an exhaust gas sensor. Further, in each graph, the solid line indicates a lambda signal sensed by a degraded exhaust gas sensor in response to the commanded lambda signal. In each of the graphs, the double arrow lines indicate where the given degradation behavior type differs from the expected lambda signal.

FIG. 2 shows a graph indicating a first type of sensor degradation that may be exhibited by a degraded exhaust gas sensor. This first type of sensor degradation is a symmetric filter type that includes slow response rate of the sensed signal to the commanded lambda signal responsive to the commanded lambda signal transitioning in both the rich-to-lean and the lean-to-rich directions. The time delay of the sensed signal from the commanded lambda signal is the same as the expected lambda response. In other words, the degraded lambda signal may start to transition from rich-to-lean and lean-to-rich at the expected times but the response rate may be lower than the expected response rate, which results in reduced lean and rich peak times. Herein, the response rate may be calculated by the derivative of the sensor output over time.

FIG. 3 shows a graph indicating a second type of sensor degradation that may be exhibited by a degraded exhaust gas sensor. The second type of sensor degradation is an asymmetric rich-to-lean filter type that includes low response rate of the sensed signal to the commanded lambda signal responsive to the commanded lambda signal transitioning in the rich-to-lean direction, but not in the lean-to-rich direction. This behavior type may start the transition from rich to lean at the expected time but the response rate may be lower than the expected response rate, which may result in a reduced lean peak time. This type of sensor degradation may be considered asymmetric because the response rate of the exhaust gas sensor is slower (or lower than expected) during the transition from rich to lean than during the transition from lean to rich. In response to this type of degradation behavior, the controller may deliver less fuel during rich-to-lean transitions. As a result, NOx emissions may increase.

FIG. 4 shows a graph indicating a third type of sensor degradation that may be exhibited by a degraded exhaust gas sensor. The third type of sensor degradation is an asymmetric lean-to-rich filter type that includes slow response rate of the sensed signal responsive to the commanded lambda signal transitioning in the lean-to-rich direction, but not in the rich-to-lean direction. This behavior type may start the transition from lean-to-rich at the expected time but the response rate may be lower than the expected response rate, which may result in a reduced rich peak time. This type of sensor degradation may be considered asymmetric because the response rate of the exhaust gas sensor is only slow (or lower than expected) responsive to the commanded lambda signal transitioning from lean-to-rich. In response to this type of sensor degradation, the controller may deliver more fuel during lean-to-rich transitions. As a result, CO emissions may increase.

FIG. 5 shows a graph indicating a fourth type of sensor degradation that may be exhibited by a degraded exhaust gas sensor. This fourth type of sensor degradation is a symmetric delay type that includes a delayed response to the commanded lambda signal transitioning in both rich-to-lean and lean-to-rich directions. In other words, the degraded lambda signal may start to transition from rich-to-lean and lean-to-rich at times that are delayed from the expected times, but the respective transition may occur at the expected response rate, which results in shifted lean and rich peak times.

FIG. 6 shows a graph indicating a fifth type of sensor degradation that may be exhibited by a degraded exhaust gas sensor. This fifth type of sensor degradation is an asymmetric rich-to-lean delay type that includes a delayed response to the commanded lambda signal responsive to the commanded lambda signal transitioning in the rich-to-lean direction, but not the lean-to-rich direction. In other words, the degraded lambda signal may start to transition from rich to lean at a time that is delayed from the expected time, but the transition may occur at the expected response rate, which results in shifted and/or reduced lean peak times. This type of behavior may be considered asymmetric because the response time of the exhaust gas sensor is only delayed from the expected start time during a transition from rich-to-lean.

FIG. 7 shows a graph indicating a sixth type of sensor degradation that may be exhibited by a degraded exhaust gas sensor. This sixth type of sensor degradation is an asymmetric lean-to-rich delay type that includes a delayed response to the commanded lambda signal responsive to the commanded lambda signal transitioning in the lean-to-rich direction, but not the rich-to-lean direction. In other words, the degraded lambda signal may start to transition from lean-to-rich at a time that is delayed from the expected time, but the transition may occur at the expected response rate, which results in shifted and/or reduced rich peak times. This type of degradation may be considered asymmetric because the response time of the exhaust gas sensor is only delayed from the expected start time during a transition from lean-to-rich.

The six sensor degradation types described above may be divided into two groups. The first group includes the filter type degradation wherein the response rate of the sensed air-fuel ratio is lower than the expected response rate (e.g., response lag increases). The response rate may be quantified with a line length or a time constant. The second group includes the delay type degradation wherein the response time of the air-fuel ratio reading is delayed. The delayed response time may be quantified with a time delay. The definitions of line length and time delay of a sensed air-fuel ratio responsive to a commanded air-fuel ratio are further introduced in detail in FIG. 8.

A filter type degradation and a delay type degradation affect the dynamics of the exhaust sensor controller differently. In response to a degraded response of the exhaust gas sensor, control compensation by the anticipatory controller may be required to maintain stability of the control system. Thus, in response to degradation of the exhaust gas sensor, the anticipatory controller parameters may be adjusted to compensate for the degradation and increase the accuracy of air-fuel ratio readings, thereby increasing engine control and performance. For example, if a delay type degradation is detected, a new controller time delay and gains may be determined based on the time delay of the degraded sensor response. If a filter type degradation is detected, a new controller time constant, time delay, and gains may be determined based on the time constant of the degraded sensor response.

The six sensor degradation types may also be divided into the symmetric type degradation and the asymmetric degradation. In the asymmetric type degradation, the sensor response has different (or asymmetric) dynamics (e.g. response rate or response time) responsive to the commanded air-fuel ratio transitioning in different directions. If the sensor degradation is asymmetric, adjusting the anticipatory controller gains and delay compensation parameters in the direction of the degradation may only maintain the stability of the closed-loop fuel control system operation. This may not be enough to allow the engine control system to operate around stoichiometry, thereby requiring further calibration of the anticipatory controller based on the severity (e.g., magnitude) of the asymmetric filter degradation. However, by transforming the asymmetric sensor response into a symmetric sensor response, the operation of the closed-loop system may be maintained around stoichiometry and the lean and/or rich bias caused by the asymmetric operation may be compensated for. Further details on compensating for and correcting asymmetric sensor responses, as well as adjusting controller parameters of the exhaust gas sensor, are described further below with reference to FIGS. 9-13.

FIG. 8 illustrates an example of determining time delay, time constant, and line length from an exhaust gas sensor response and its corresponding commanded air-fuel ratio. Specifically, FIG. 8 shows a graph 210 illustrating a commanded lambda, expected lambda, and degraded lambda, similar to the lambdas described with respect to FIGS. 2-7. FIG. 8 illustrates a rich-to-lean delay degradation wherein the response time of the degraded lambda to the commanded air-fuel ratio transition is delayed. The arrow 202 illustrates the time delay, which is the time duration from the change in commanded lambda to a time (To) when a threshold change in the measured lambda is observed. The threshold change in lambda may be a small change that indicates the response to the commanded change has started, e.g., 5%, 10%, 20%, etc. The arrow 204 indicates the time constant ($\tau_{63}$) for the response, which in a first order system is the time from $\tau_0$ to when 63% of the steady state response is achieved. The arrow 206 indicates the time duration from $\tau_0$ to when 95% of the desired response is achieved, otherwise referred to as a threshold response time ($\tau_{95}$). In a first order system, the threshold response time ($\tau_{95}$) is approximately equal to three time constants ($3*\tau_{63}$).

From these parameters, dynamics of the sensor response may be quantified. Further, types and magnitude of the sensor degradation may be determined. For example, the time delay, indicated by arrow 202, may be compared to an expected time delay to determine if the sensor is exhibiting a delay degradation behavior. The time constant, indicated by the arrow 204, may be used to predict a $\tau_{95}$. Finally, the line length may be determined based on the change in lambda over the duration of the response, starting at $\tau_0$. The line length is the sensor signal length, and can be used to determine if a response degradation (e.g., filter type degradation) is present. The line length may be determined based on the equation:

$$\text{line length}=\Sigma\sqrt{\Delta t^2+\Delta\lambda^2},$$

wherein $\Delta t$ indicates the time increments, and $\Delta\lambda$ indicates the normalized measured lambda increments from the UEGO. If the determined line length is greater than an expected line length, the exhaust gas sensor may be exhibiting a filter type degradation. A time constant and/or time delay of the degraded exhaust gas sensor response may be used to adapt parameters of the exhaust gas sensor controller for air-fuel ratio control. Methods for adapting the controller parameters based on the degradation behavior are presented below at FIG. 13.

Turning to FIG. 9, an example method 900 of air-fuel ratio control is shown. Sensed air-fuel ratio from an exhaust gas sensor is fed to the exhaust gas sensor controller including an anticipatory controller and a PI controller. The anticipatory controller may be adapted to compensate for sensor degradation. Method 900 may determine the type and magnitude of the sensor degradation. Responsive to the asymmetric type sensor degradation, the sensed air-fuel ratio may be modified to a symmetric response before inputting to the anticipatory controller of the exhaust gas sensor controller. The method may also include adapting one or more parameters of the exhaust gas sensor controller based on the type and magnitude of the sensor degradation.

Instructions for carrying out method 900 and the rest of the methods included herein may be executed by a controller (such as controller 12 of FIG. 1) based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 902, method 900 determines engine operating conditions. Engine operating conditions may be determined based on feedback from various engine sensors, and may include engine speed and load, air-fuel ratio, temperature, etc.

At 904, method 900 determines if exhaust gas sensor monitoring conditions are met based on the engine operating conditions. For example, the exhaust gas sensor monitoring conditions may include that the engine is running and the input parameters are operational and/or that the exhaust gas sensor is at a temperature whereby it is outputting functional readings. Further, the exhaust gas sensor monitoring conditions may include that combustion is occurring in the cylinders of the engine, e.g. that the engine is not in a shut-down mode such as deceleration fuel shut-off (DFSO). The exhaust gas sensor monitoring conditions may also include that the engine is operating in steady-state conditions.

If it is determined that the engine is not running and/or the selected conditions are not met, method 900 continues monitoring engine operating conditions at 906. However, if the exhaust gas sensor conditions are met at 904, the method proceeds to 908 to collect the commanded air-fuel ratio output from controller 12, and corresponding data from the exhaust gas sensor. This may include collecting and storing air-fuel ratio (e.g., lambda) data detected by the sensor. The data collection may be continued until a necessary number of samples (e.g., air-fuel ratio data) are collected.

At 910, method 900 includes determining if the exhaust gas sensor is degraded, based on the commanded air-fuel ratio and the corresponding sensed air-fuel ratio from the exhaust gas sensor. The method at 910 may further include determining the type and magnitude of sensor degradation.

Various methods may be used to determine the type of exhaust gas sensor degradation. In one example, degradation may be determined based on the time delay and the line length of the sensed air-fuel ratio respective to the commanded air-fuel ratio. For example, responsive to the transition of the commanded air-fuel ratio in the rich-to-lean or lean-to-rich direction, the time delay and line length of the sensed air-fuel ratio with respect to the commanded air-fuel ratio is determined according to FIG. 8. If the time delay is greater than an expected time delay, delay type sensor degradation may be determined. If the line length is greater than an expected line length, filter type sensor degradation may be determined. If the time delays or the line lengths are different responsive to the commanded air-fuel ratio transitioning in the rich-to-lean and the lean-to-rich direction, asymmetric sensor degradation may be determined. If the time delays are the same responsive to the commanded air-fuel ratio transitioning in both directions, and the time delay is greater than the expected time delay, symmetric delay type sensor degradation may be determined. If the line lengths are the same responsive to the commanded air-fuel ratio transitioning in both directions, and the line lengths are greater than the expected time delay, symmetric filter type sensor degradation may be determined. The magnitude of sensor degradation may be measured by degraded time delay (time delay greater than the expected time delay) and the degraded line length (line length greater than the expected line length) of the degraded sensor signal. In another example, the magnitude of sensor degradation may be measured by degraded time constant (time constant greater than the expected time constant). If the time delays or the line lengths during sensed air-fuel ratio transitioning in both directions are greater than the expected time delay or the expected line lengths, the degraded time delay or the degraded line length of the sensor may be set to the greater degraded time delay or the greater degraded line length. For example, method 900 may determine a first time delay of the sensed air-fuel ratio from the commanded air-fuel ratio responsive to the commanded air-fuel ratio transitioning in a first direction, and determine a second time delay of the sensed air-fuel ratio from the commanded air-fuel ratio responsive to the commanded air-fuel ratio transitioning in a second direction. Method 900 may determine the asymmetric type sensor degradation if the first delay is different from the second delay. If the first and the second time delays are both greater than the expected delay, and the first time delay is less than the second time delay, the degraded time delay of the sensor is set to be the second time delay. The expected time delay and expected line length may be thresholds predetermined with a non-degraded sensor.

In another example, the type and magnitude of sensor degradation may be determined based on time constant instead of line length.

In another example, exhaust gas sensor degradation may be detected by monitoring characteristics of a distribution of extreme values from multiple sets of successive sensed air-fuel ratio samples during steady state operating conditions. In one example, the characteristics may be a mode and central peak of a generalized extreme value (GEV) distribution of the extreme lambda differentials collected during steady state operating conditions. Asymmetric sensor degradation may be determined based on the magnitude of the central peak and/or the magnitude of the mode. Further classification, for example symmetric sensor degradation may be determined may be based on the time delay or the time constant of the sensed air-fuel ratio relative to the commanded air-fuel ratio. Specifically, if the time delay is greater than a nominal time delay, a sensor symmetric delay is indicated (e.g., indicates delay type degradation). The nominal sensor time delay is the expected delay in sensor response to a commanded air-fuel ratio change based on the delay from when the fuel is injected, combusted, and the exhaust travels from the combustion chamber to the exhaust sensor. The sensor time delay may be when the sensor actually outputs a signal indicating the changed air-fuel ratio. Similarly, if the sensor time constant is greater than a nominal time constant, a sensor symmetric response degradation behavior is indicated (e.g., indicates filter type degradation). The nominal time constant may be the time constant indicating how quickly the sensor responds to a commanded change in lambda, and may be determined off-line with a non-degraded sensor. As discussed above, the determined time constant and/or time delay of the degraded exhaust gas sensor response may be used by the controller to adapt controller parameters.

In yet another example, exhaust gas sensor degradation may be indicated by parameters estimated from two operation models, a rich combustion model and a lean combustion model. Commanded air-fuel ratio and the sensed air-fuel ratio acquired from the sensor may be compared with the assumption that the combustion that generated the air-fuel ratio was rich (e.g., inputting the commanded lambda into the rich model) and also compared assuming that the combustion event was lean (e.g., inputting the commanded lambda into the lean model). For each model, a set of parameters may be estimated that best fits the commanded lambda values with the measured lambda values. The model parameters may include a time constant, time delay, and static gain of the model. The estimated parameters from each model may be compared to each other, and the type of sensor degradation (e.g., filter vs. delay) may be indicated based on differences between the estimated parameters.

At 912, method 900 determines whether sensor degradation is detected at 910. If sensor degradation is not detected, method 900 moves to 914, and the air-fuel ratio of the engine is adjusted based on current exhaust gas sensor controller parameters. If sensor degradation is detected, method 912 moves to 916.

At 916, method 900 determines whether asymmetric type sensor degradation is detected at 910. Responsive to asymmetric sensor degradation, method 900 moves to 918 and modifies the degraded asymmetric sensor response to a symmetric response. Detailed procedures of the modification is shown in FIG. 10. If the sensor degradation is not the asymmetric type sensor degradation, method 900 moves to step 920.

At 920, method 900 adapts or adjusts parameters of the exhaust gas sensor controller based on the type and magnitude of sensor degradation. The magnitude of sensor degradation may include one or more of a time delay, a time constant, and a line length illustrated in FIG. 8. In one example, method 900 may determine the magnitude of sensor degradation based on the modified, symmetric response at 918. The exhaust gas sensor controller parameters may include one or more parameters of the PI controller and the anticipatory controller. Detailed procedures of controller parameter adaptation are shown in FIG. 13.

At 922, the engine is operated with the adapted exhaust gas sensor controller based on the feedback of the sensed air-fuel ratio. If the sensor has asymmetric type sensor degradation, the air-fuel ratio is controlled with the adapted controller based on the feedback of the modified, symmetric air-fuel ratio. As one example, the filtered symmetric response may be fed back to an adapted anticipatory controller and subsequently be used to adjust fuel injection to the engine cylinder.

In this way, only symmetric responses are processed by the adapted exhaust gas sensor controller to generate the commanded air-fuel ratio for air-fuel ratio control. The symmetric responses may be sensor response with symmetric type fault or modified sensor responses from 918. Asymmetric engine operation due to asymmetric sensor responses to air-fuel ratio transition directions may be avoided.

FIG. 10 shows an example method 1000 for modifying asymmetric sensor response to symmetric response. As one example, degradation may be introduced to the un-faulted portion of the sensed air-fuel ratio, so that the dynamics (e.g. response rate and response time) of sensor response are the same (or symmetric) with respect to the commanded air-fuel ratio transition directions or the sensed air-fuel ratio transition directions. As another example, the portion of sensor response with a lower magnitude of degradation (e.g. less response rate or less response time) may be modified, so that the dynamics of the sensor response are the same (or symmetric) with respect to the commanded air-fuel ratio transition directions or the sensed air-fuel ratio transition directions.

At 1002, method 1000 determines if asymmetric delay type sensor degradation is detected. If the answer is YES, method 1000 moves on to 1004 or 1008 based on the specific type of delay degradation. If no asymmetric delay type sensor degradation is detected, method 1000 moves to 1018.

Responsive to rich-to-lean delay type sensor degradation (as shown in FIG. 6) at 1004, method 1000 selects the portion of the sensed air-fuel ratio with lean-to-rich transition at 1006, and introduces delay to the selected portion at 1016, but does not introduce delay to the portion of sensed air-fuel ratio with rich-to-lean transition at 1012. Responsive to lean-to-rich delay type sensor degradation (shown in FIG. 7) at 1008, method 1000 selects the portion of sensed air-fuel ratio with rich-to-lean transition at 1010, and introduces delay to the selected portion at 1016, but does not introduce delay to the portion of sensed air-fuel ratio with lean-to-rich transition at 1014. As such, the delay is only introduced to the un-faulted portion of the asymmetric sensor response. The faulted portion of the asymmetric sensor response is unaltered. The modified sensor response resembles the symmetric delay type sensor degradation, that is, with the same amount of time delay in both the lean-to-rich and rich-to-lean transitions.

At 1016, the un-faulted portion of the sensed air-fuel ratio is delayed to generate a symmetric response. For example, for a sensor with rich-to-lean delay type degradation, a time delay is introduced during the sensed air-fuel ratio transitioning from lean to rich. As another example, for a sensor with lean-to-rich delay type degradation, the time delay is introduced during the sensed air-fuel ratio transitioning from rich to lean. The introduced time delay may be the difference between the time delays of the faulted and the un-faulted portion of the sensed air-fuel ratio, or the difference between the time delays of the sensed air-fuel ratio transitioning in opposite directions. In this way, the modified air-fuel ratio has an averaged air-fuel ratio the same as the commanded air-fuel ratio over time.

As one example, the delay may be introduced by filtering the un-faulted portion of the sensed air-fuel ratio through a filter. The filter may be constructed in the form of $$S_{filtered}(k) = S\left(k - \frac{TD}{DT}\right),$$

wherein $S_{filtered}(k)$ indicates the kth filtered air-fuel ratio, S is the sensed air-fuel ratio with delay degradation, TD is the degraded time delay, and DT is the sampling time of the sensed air-fuel ratio.

In alternate examples, the exhaust gas sensor may experience asymmetric delay type sensor degradation with degradation in both directions of transition. For example, the lean-to-rich transition may be degraded by a first amount (e.g., having a first time delay) and the rich-to-lean transition may be degraded by a second amount (e.g., having a second time delay), the first amount and the second amount being different. In one example, the first time delay may be greater than the second time delay, thereby resulting in a slower response time in the lean-to-rich direction comparing to the rich-to-lean direction. In this example, additional time delay may be introduced to the rich-to-lean transition direction so that it has a same time delay as the first time delay. In this way, the asymmetric sensor response may become symmetric.

As an example, FIG. 11 shows graphical examples of an exhaust gas sensor output with rich-to-lean delay degradation and a corresponding filtered response. Specifically, graph 1102 shows a commanded air-fuel ratio at plot 1106, an expected air-fuel ratio at plot 1108, and a sensed air-fuel ratio at plot 1110. As seen at plot 1108, the expected air-fuel ratio is symmetric around stoichiometry (e.g., lambda=1). In other words, the lean peak amplitude 1112 and the rich peak amplitude 1114 of the expected air-fuel ratio (e.g., expected sensor response) are substantially equal.

The degraded lambda shown at plot 1110 has a response time greater than the expected air-fuel ratio 1108 in the lean-to-rich direction or transition (for example, during time duration indicated by 1122). However, the response time of the sensed air-fuel ratio 1110 is of the same response time as the expected air-fuel ratio 1108 in the rich-to-lean transition (as indicated by 1120). As such, the dynamics of the sensor response is different with respect to the direction of the transition direction (e.g. rich-to-lean or lean-to-rich) of the sensor output or the commanded air-fuel ratio. Therefore, the sensor response is asymmetric. The lean peak amplitude 1116 and the rich peak amplitude 1112 are not equal. Since the asymmetric delay degradation is only in the lean-to-rich direction, the lean peak amplitudes of the expected response (plot 1108) and the degraded response (plot 1110) are substantially the same. However, the rich peak amplitude 1116 of the degraded response (plot 1110) is smaller than the lean peak amplitude 1114 of the expected response (plot 1108). Further, the area of the sensed air-fuel ratio during lean burn (area 1140) is greater than the area during rich burn (area 1141). As a result, the averaged air-fuel ratio (i.e., air-fuel ratio averaged over time) of the sensed air-fuel ratio (line 1118) over time deviates from the averaged air-fuel ratio of the commanded air-fuel ratio. Thus, the asymmetric delay type degradation causes the engine system operation to deviate from stoichiometry.

The asymmetric degraded sensor response (plot 1110) includes a faulted portion 1122 (sensed air-fuel ratio moves in the direction of rich-to-lean), wherein the time delay of the degraded sensed air-fuel ratio with respect to the commanded air-fuel ratio is greater than the time delay of the expected air-fuel ratio. In the un-faulted portion 1120 (sensed air-fuel ratio moves in the direction of lean-to-rich), the time delay of the sensed air-fuel ratio is the same as the expected air-fuel ratio.

In response to an asymmetric filter type sensor response (such as the asymmetric delay degradation response shown at plot 1102), a controller (such as dedicated controller 140 or controller 12 shown in FIG. 1) may filter or modify the asymmetric response to a more symmetric response by introducing delay to the sensed air-fuel ratio in the un-faulted portion (e.g. portion 1120). The modified symmetric response may have a same on magnitude of degradation (e.g., time delay) when transitioning in both rich-to-lean and lean-to-rich directions. Graph 1104 shows an example of the modified symmetric response (shown at plot 1128) resulting from modifying the asymmetric sensor response (plot 1110) shown in graph 1102.

Specifically, graph 1104 shows the same commanded air-fuel ratio and the expected air-fuel ratio as shown in graph 1102 at plots 1124 and 1126, respectively. Additionally, graph 1104 shows a modified response at plot 1128. The modified response may be achieved by selectively modifying the un-faulted portion 1120 (e.g., non-degraded portion) of the asymmetric sensor response (plot 1110) based on the time delay of the faulted portion 1122 (e.g., degraded portion) of the asymmetric sensor response. As a result of the modification, the area under the filtered air-fuel ratio during rich air-fuel ratio (1151) and the area under the filtered air-fuel ratio during lean air-fuel ratio (1150) are the same. Therefore, the modified air-fuel ratio has an averaged air-fuel ratio the same as the averaged air-fuel ratio of the commanded air-fuel ratio. In another example, the areas of filtered air-fuel ratio during rich and lean burn are within a threshold of stoichiometry. This threshold may be smaller than the area difference between area 1140 and 1141 of the sensed air-fuel ratio in plot 1102. Thus, the modified air-fuel ratio has a more symmetric response around stoichiometry than the sensed air-fuel ratio.

Note that in the example of FIG. 11, the average of the commanded air-fuel ratio is around 1. In other examples, the average of the commanded air-fuel ratio may be different from 1. The asymmetric sensor response may be filtered to have an average the same as the average of the commanded air-fuel ratio.

Turning back to FIG. 10, at 1018, method 1000 determines if asymmetric filter type sensor degradation is detected. If the answer is YES, method 1000 moves on to 1020 or 1024 based on the specific type of filter degradation. If no asymmetric delay type sensor degradation is detected, method 1000 returns to 918 of method 900, and continues on to 920 to adapt parameters of the exhaust gas sensor controller.

Responsive to rich-to-lean type filter type sensor degradation (shown in FIG. 3) at 1020, method 1000 selects the portion of sensed air-fuel ratio with lean-to-rich transition at 1022, and filter the selected portion at 1032, but does not filter the portion of sensed air-fuel ratio with rich-to-lean transition at 1028. Responsive to lean-to-rich filter type sensor degradation (shown in FIG. 4) at 1024, method 1000 selects the portion of sensed air-fuel ratio with rich-to-lean transition at 1026, and filter the selected portion at 1032, but does not filter the portion of sensed air-fuel ratio with lean-to-rich transition at 1030. As such, only the un-faulted portion of the asymmetric sensor response is filtered. The faulted portion of the asymmetric sensor response is unaltered.

At 1032, a filter is applied to the un-faulted portion of the sensed air-fuel ratio to generate a symmetric response. For example, for a sensor with rich-to-lean filter type degradation, the filter is applied during the sensed air-fuel ratio transitioning from lean to rich. As another example, for a sensor with lean-to-rich filter type degradation, the filter is applied during the sensed air-fuel ratio transitioning from rich to lean. The filtered air-fuel ratio has an averaged air-fuel ratio over time the same as the commanded air-fuel ratio.

As one example, the filter may be constructed in the following of $$S_{filtered}(k) = \frac{TC}{TC + DT} S_{filtered}(k-1) + \frac{DT}{TC + DT} S,$$

wherein S indicates the current sensor air-fuel ratio with filter fault, TC is the time constant, DT is the sampling rate of the sensed air-fuel ratio, and $S_{filtered}$ is the filtered air-fuel ratio.

In alternate examples, the exhaust gas sensor may experience asymmetric filter degradation with degradation in both transition directions. For example, the lean-to-rich transition may be degraded by a first amount (e.g., having a first time constant) and the rich-to-lean transition may be degraded by a second amount (e.g., having a second time constant), the first amount and the second amount being different. In one example, the first time constant may be greater than the second time constant, thereby resulting in a slower response in the lean-to-rich direction than the rich-to-lean direction. In this example, the lean-to-rich transition direction may be filtered so that it has a similar time constant to the second time constant. In this way, the asymmetric response may become more symmetric around stoichiometry.

FIG. 12 shows graphical examples of an exhaust gas sensor output with rich-to-lean filter degradation and a corresponding filtered response. Specifically, graph 1202 shows a commanded air-fuel ratio at plot 1206, an expected air-fuel ratio at plot 1208, and a sensed air-fuel ratio at plot 1210. As seen at plot 1208, the expected air-fuel ratio is symmetric around stoichiometry (e.g., lambda=1). In other words, the lean peak amplitude 1212 and the rich peak amplitude 1214 of the expected air-fuel ratio (e.g., expected sensor response) are substantially equal.

The degraded lambda shown at plot 1210 has a response rate lower than the expected ari-fuel ratio 1208 in the rich-to-lean direction or transition (for example, during time duration indicated by 1222). However, the response rate of the degraded lambda 1210 is of the same response rate as the expected lambda 1208 in the lean-to-rich transition (as indicated by 1220). As such, the dynamics of the sensor response is different with respect to the direction of the transition direction (e.g. rich-to-lean or lean-to-rich) of the sensor output or the commanded air-fuel ratio. Therefore, the sensor response is asymmetric. The lean peak amplitude 1216 and the rich peak amplitude 1214 are not equal. Since the asymmetric filter degradation is only in the rich-to-lean direction, the rich peak amplitudes of the expected response (plot 1208) and the degraded response (plot 1210) are substantially the same. However, the lean peak amplitude 1216 of the degraded response (plot 1210) is smaller than the lean peak amplitude 1212 of the expected response (plot 1208). Thus, as shown by accumulated air-fuel ratio of the sensed air-fuel ratio (line 1218), the asymmetric filter type degradation causes the engine system operation to deviate from stoichiometry.

The asymmetric degraded response (plot 1210) includes a faulted portion 1222 (degraded response moves in the direction of rich-to-lean), wherein the slope of the degraded lambda is slower than the slope of the expected lambda. In the un-faulted portion 1220 (degraded response moves in the direction of lean-to-rich), the slope of the degraded lambda is the same as the slope of the expected lambda.

In response to an asymmetric filter type sensor response (such as the asymmetric filter degradation response shown at plot 1202), a controller (such as dedicated controller 140 or controller 12 shown in FIG. 1) may filter or modify the asymmetric response to a more symmetric response by filtering the sensed air-fuel ratio in the un-faulted portion (e.g. portion 1222). The filtered symmetric response may have a same magnitude of degradation (e.g., time constant or line length) when transitioning in both rich-to-lean and lean-to-rich directions. Graph 1204 shows an example of a symmetric filtered response (shown at plot 1228) resulting from filtering the asymmetric sensor response (plot 1210) shown in graph 1202.

Specifically, graph 1204 shows the same commanded air-fuel ratio and the expected air-fuel ratio as shown in graph 1202 at plots 1224 and 1226, respectively. Additionally, graph 1204 shows a filtered or modified response at plot 1228. The filtered response may be achieved by selectively filtering the un-faulted portion 1220 (e.g., non-degraded portion) of the asymmetric sensor response (plot 1210) based on the time constant of the faulted portion 1222 (e.g., degraded portion) of the asymmetric sensor response. As a result of the filtering, the modified response (plot 1228) is more symmetric around stoichiometry than the degraded response shown at plot 1210. As shown at plot 1228, the lean peak amplitude 1230 and the rich peak amplitude 1232 are substantially the same. In other examples, the lean peak amplitude 1230 and the rich peak amplitude 1232 of the modified response may be within a threshold of one another. This threshold may be smaller than the difference between the rich peak amplitude 1214 and the lean peak amplitude 1216 of the asymmetric degraded response (plot 1210). Therefore, the averaged filtered air-fuel ratio is the same as the averaged commanded air-fuel ratio.

Note that in the example of FIG. 12, the average of the commanded air-fuel ratio is around 1. In other examples, the average of the commanded air-fuel ratio may be different from 1. The asymmetric sensor response may be filtered to have an average the same as the average of the commanded air-fuel ratio.

FIG. 13 shows method 1300 for adapting parameters of the exhaust gas sensor controller based on the type and magnitude of sensor degradation. The exhaust gas sensor controller may include a PI controller and an anticipatory controller (such as a SP delay compensator). Method 1300 may be carried out by controller 12 and/or dedicated controller 140, and may be executed during 920 of method 900 described in FIG. 9. As an example, the time constant and/or time delay of the degraded sensor response with respect to the commanded air-fuel ratio are determined. These parameters may be referred to herein as the degraded (e.g., faulted) time constant, $T_{C\text{-}F}$, and the degraded time delay, $T_{D\text{-}f}$. The degraded time constant and time delay may then be used, along with the nominal time constant, $T_{C\text{-}nom}$, and nominal time delay, $T_{D\text{-}nom}$, to determine parameters of the anticipatory controller and the PI controller. As discussed above, the adapted controller parameters may include a proportional gain, $K_P$, an integral gain, $K_I$, a controller time constant, $T_{C\text{-}SP}$, and controller time delay, $T_{D\text{-}SP}$. The adapted controller parameters may be further based on the nominal system parameters (e.g., parameters pre-set in the anticipatory controller).

At 1302, method determines whether the sensor has filter type sensor degradation. If the answer is YES, method 1300 moves to step 1310, wherein the engine system is approximated by a first order model and the parameters of the exhaust gas sensor controller is adapted based on the time constant. If the answer is at 1302 is NO, method 1300 moves to 1304 to determine if the degradation is delay type degradation. If the sensor has delay type degradation, method moves on to 1324, wherein the parameters of the exhaust gas sensor controller are determined based on time delay. If the answer at 1304 is NO, method 1300 determines that the sensor exhibits no degradation, and controller parameters maintain the same.

At 1310, method 1300 includes estimating the degraded time constant, $T_{C\text{-}F}$, and the nominal time constant, $T_{C\text{-}nom}$. The nominal time constant may be the time constant indicating how quickly the sensor responds to a commanded change in air-fuel ratio, and may be determined off-line based on non-degraded sensor function. The degraded time constant may be estimated using any of the methods for determining degradation at 910 in method 900. Alternatively, the time degraded time constant may be estimated based on the filtered air-fuel ratio and the commanded air-fuel ratio. After determining the degraded time constant $T_{C\text{-}F}$ and the nominal time constant $T_{C\text{-}nom}$, method 1300 proceeds to 1312 to approximate the second order system by a first order model (e.g., FOPD). The method at 1312 may include applying a half rule approximation to the degraded system. The half rule approximation includes distributing the smaller time constant (between the nominal and degraded time constants) evenly between the larger time constant and the nominal time delay. This may be done using the following equations:

$$T_{C\text{-}Equiv} = \mathrm{MAX}(T_{C\text{-}F}, T_{C\text{-}nom}) + \frac{1}{2} * \mathrm{MIN}(T_{C\text{-}F}, T_{C\text{-}nom})$$

$$T_{D\text{-}Equiv} = T_{D\text{-}nom} + \frac{1}{2} * \mathrm{MIN}(T_{C\text{-}F}, T_{C\text{-}nom})$$

If the degraded time constant $T_{C\text{-}F}$ is smaller than the nominal time constant $T_{C\text{-}nom}$ the equations become:

$$T_{C\text{-}Equiv} = T_{C\text{-}nom} + \frac{1}{2} T_{C\text{-}F}$$

$$T_{D\text{-}Equiv} = T_{D\text{-}nom} + \frac{1}{2} T_{C\text{-}F}$$

At 1314, the controller may replace the controller time constant, $T_{C\text{-}SP}$, and the controller time delay, $T_{D\text{-}SP}$, used in the SP delay compensator (in the anticipatory controller) with the determined equivalent time constant, $T_{C\text{-}Equiv}$, and the equivalent time delay, $T_{D\text{-}Equiv}$.

At 1316, the controller determines an intermediate multiplier, alpha. The intermediate multiplier is defined by the following equation:

$$\text{Alpha} = \frac{T_{D\text{-}nom}}{(T_{D\text{-}Equiv})}$$

The intermediate multiplier alpha may be used to determine the integral gain $K_I$ of the PI controller at 1318. The integral gain $K_I$ is determined from the following equation:

$$K_I = \text{alpha} * K_{I\text{-}nom}$$

Where $K_{I\text{-}nom}$ is the nominal integral gain of the PI controller. Since alpha=1 for a filter degradation, $K_I$ is maintained at the nominal value.

At 1320, method 1300 determines the proportional gain of the PI controller, $K_P$, based on the integral gain $K_I$ and the equivalent time constant $T_{C\text{-}Equiv}$. The proportional gain $K_P$ is determined from the following equation:

$$K_P = T_{C\text{-}Equiv} * K_I$$

As the magnitude of the filter degradation increases (e.g., such as the degraded time constant increases), the equivalent time constant $T_{C\text{-}Equiv}$ increases, thereby increasing $K_P$. After determining the new controller parameters, the method returns to 920 of method 900 and continues on to 922 to apply the new controller parameters in engine air-fuel ratio control.

In this way, the controller gains, time constant, and time delay may be adjusted based on the magnitude and type of degradation behavior. Specifically, for a filter type degradation (e.g., time constant degradation), the proportional gain, the integral gain, and controller time constant and time delay ($T_{C\text{-}SP}$ and $T_{D\text{-}SP}$) may be adjusted based on the degraded time constant.

At 1324, method 1300 includes estimating the degraded time delay, $T_{D\text{-}F}$, and the nominal time delay, $T_{D\text{-}nom}$. The nominal time delay is the expected delay in exhaust gas sensor response to a commanded air-fuel ratio change based on the delay from when the fuel is injected, combusted, and the exhaust travels from the combustion chamber to the exhaust sensor. The degraded time delay $T_{D\text{-}F}$ may be estimated at 910 of method 900. Alternatively, the time degraded time delay may be estimated based on the filtered air-fuel ratio and the commanded air-fuel ratio.

After determining the degraded time delay $T_{D\text{-}F}$ and the nominal time delay $T_{D\text{-}nom}$, method 1300 proceeds to 1326 to determine the equivalent time delay, $T_{D\text{-}Equiv}$, based on the degraded time delay $T_{D\text{-}F}$ and the nominal time delay $T_{D\text{-}nom}$. The equivalent time delay $T_{D\text{-}Equiv}$ may be estimated by the following equation:

$$T_{D\text{-}Equiv} = T_{D\text{-}nom} + T_{D\text{-}F}$$

In this way, the equivalent time delay is the extra time delay (e.g., degraded time delay) after the expected time delay (e.g., nominal time delay).

The time constant may not change for a delay degradation. Thus, at 1328, the equivalent time constant $T_{C\text{-}Equiv}$ may be set to the nominal time constant $T_{C\text{-}nom}$.

At 1330, method 1300 may replace the controller time constant, $T_{C\text{-}SP}$, and the controller time delay, $T_{D\text{-}SP}$, used in the SP delay compensator (in the anticipatory controller) with the determined equivalent time constant, $T_{C\text{-}Equiv}$, and the equivalent time delay, $T_{D\text{-}Equiv}$. For the delay degradation, the controller time constant $T_{C\text{-}SP}$ may remain unchanged.

At 1332, the controller determines the intermediate multiplier, alpha. The intermediate multiplier may be based on the degraded time delay and the nominal time delay. The intermediate multiplier is defined by the following equation:

$$\text{Alpha} = \frac{T_{D\text{-}nom}}{(T_{D\text{-}nom} + T_{D\text{-}f})}$$

The intermediate multiplier alpha may then be used to determine the integral gain $K_I$ of the PI controller at 1334. The integral gain $K_I$ is determined from the following equation:

$$K_I = \text{alpha} * K_{I\text{-}nom}$$

Where $K_{I\text{-}nom}$ is the nominal integral gain of the PI controller. As the magnitude of the delay degradation (such as the degraded time constant) increases, alpha may decrease. This, in turn, causes the integral gain $K_I$ to decrease. Thus, the integral gain may be reduced by a greater amount as the degraded time delay $T_{D\text{-}F}$ and magnitude of the delay degradation increases.

At 1336, method 1300 determines the proportional gain, $K_P$, based on the integral gain $K_I$ and the equivalent time constant $T_{C\text{-}Equiv}$. The proportional gain $K_P$ is determined from the following equation:

$$K_P = T_{C\text{-}Equiv} * K_I$$

Since the equivalent time constant $T_{C\text{-}Equiv}$ may not change for a delay type degradation, the proportional gain $K_P$ may be based on the integral gain $K_I$. Thus, as $K_I$ decreases with increasing degraded time delay $T_{D\text{-}F}$, the proportional grain $K_P$ also decreases. After determining the new anticipatory controller parameters, the method returns to 920 of method 900 and continues on to 922 to apply the new controller parameters for engine air-fuel ratio control.

In this way, the controller gains, time constant, and time delay may be adjusted based on the magnitude and type of degradation behavior. Specifically, for a delay type degradation (e.g., time delay degradation), the proportional gain, integral gain, and controller time delay ($T_{D\text{-}SP}$) may be adjusted based on the degraded time delay while the controller time constant ($T_{C\text{-}SP}$) is maintained.

As described above, an engine method may include adjusting fuel injection responsive to exhaust oxygen feedback from an exhaust sensor and converting an asymmetric degradation sensor response of the exhaust sensor to a symmetric degradation response based on the type and magnitude of the asymmetric sensor response. For example, the asymmetric degradation response may be an asymmetric delay degradation response with a degraded time delay in only one transition direction. Converting the asymmetric delay type response to the more symmetric response may include filtering an un-faulted transition of the asymmetric sensor response, but not filtering a faulted transition of the asymmetric sensor response. In one example, filtering the un-faulted transition of the asymmetric sensor response may include filtering a rich-to-lean transition of the sensor response when the sensor degradation is lean-to-rich type. In another example, filtering the un-faulted transition of the asymmetric sensor response may include filtering a lean-to-rich transition of the sensor response when the sensor degradation is rich-to-lean type. Further, the un-faulted transition of the asymmetric sensor response may be filtered by an amount based on the dynamics of the faulted transition of the asymmetric sensor response. In one example, the magnitude of the degraded delay transition may be quantified with a time delay, and the un-faulted transition of the asymmetric delay type sensor response is filtered based on the time delay. The method may further include adjusting one or more parameters of an exhaust gas sensor controller of the exhaust gas sensor responsive to the filtered symmetric response. In one example, adjusting one or more parameters of the exhaust gas sensor controller may include adapting the one or more parameters based on the time delay and time constant of the filtered symmetric response. The engine is then operated with the adapted air-fuel controller responsive to feedback of the filtered symmetric response.

The technical effect of modifying the asymmetric sensor response to a symmetric response is that the asymmetric engine operation may be avoided. The technical effect of filtering un-faulted portion of the sensor response is that the filtered response may have the same dynamic when the commanded air-fuel ratio increases and decreases, and the average air-fuel ratio of the filtered sensor response may be the same as the commanded air-fuel ratio. The technical effect of adjusting the controller parameters based on sensor degradation is that the accuracy of the air-fuel ratio command tracking may increase and the stability of the controller may increase.

As one embodiment, a method comprises sensing an air-fuel ratio via an exhaust gas sensor; responsive to an asymmetric sensor response, generating a modified air-fuel ratio with symmetric response based on the sensed air-fuel ratio; and adjusting fuel injection based on the modified air-fuel ratio. In a first example of the method, the asymmetric sensor response includes sensor response with different dynamics when a commanded air-fuel ratio transitions in different directions. A second example of the method optionally includes the first example and further includes determining a first time delay of the sensed air-fuel ratio from a commanded air-fuel ratio when the sensed air-fuel ratio transitioning in a first direction; determining a second time delay of the sensed air-fuel ratio from the commanded air-fuel ratio when the sensed air-fuel ratio transitioning in a second, different, direction; and determining the asymmetric sensor response responsive to the first time delay different from the second time delay. A third example of the method optionally includes one or more of the first and second examples, and further includes, wherein the first time delay is less than the second time delay, and the time delays of the modified air-fuel ratio responsive to the commanded air-fuel ratio transitioning in different directions are the same as the second time delay. A fourth example of the method optionally includes one or more of the first through third examples, and further includes, wherein an averaged air-fuel ratio of the modified air-fuel ratio over time is the same as an averaged air-fuel ratio of the commanded air-fuel ratio over time. A fifth example of the method optionally includes one or more of the first through fourth examples, and further includes, determining a type of sensor degradation and a magnitude of sensor degradation based on the sensed air-fuel ratio and the commanded air-fuel ratio, and generating the modified air-fuel ratio based on the type and the magnitude of the sensor degradation. A sixth example of the method optionally includes one or more of the first through fifth examples, and further includes, adjusting the fuel injection via an exhaust gas sensor controller, and adapting one or more parameters of the controller responsive to the type of sensor degradation and the magnitude of sensor degradation. A seventh example of the method optionally includes one or more of the first through sixth examples, and further includes, wherein the exhaust gas sensor controller includes a feedback control routine and a Smith Predictor. An eighth example of the method optionally includes one or more of the first through seventh examples, and further includes, adjusting the fuel injection via the adapted exhaust gas controller based on the modified air-fuel ratio.

As another embodiment, a method includes operating engine components with a commanded air-fuel ratio; sensing an air-fuel ratio via an exhaust gas sensor; determining a sensor degradation based on the sensed air-fuel ratio; modifying the sensed air-fuel ratio responsive to an asymmetric type sensor degradation, wherein the modified air-fuel ratio has a symmetric response; and adjusting a fuel injection based on the modified air-fuel ratio. In a first example of the method, wherein determining the sensor degradation includes determining a time constant and a time delay of the sensed air-fuel ratio with respect to the commanded air-fuel ratio. A second example of the method optionally includes the first example and further includes, wherein modifying the sensed air-fuel ratio includes delaying an un-faulted portion of the sensed air-fuel ratio, responsive to an asymmetric delay type sensor degradation. A third example of the method optionally includes one or more of the first and second examples, and further includes, wherein modifying the sensed air-fuel ratio includes filtering an un-faulted portion of the sensed air-fuel ratio based on the time constant, responsive to an asymmetric filter type sensor degradation. A fourth example of the method optionally includes one or more of the first through third examples, and further includes, adjusting the fuel injection based on a feedback of the filtered air-fuel ratio modified an exhaust gas sensor controller, wherein parameters of the exhaust gas sensor controller are adapted based on the sensor degradation. A fifth example of the method optionally includes one or more of the first through fourth examples, and further includes, wherein the parameters of the exhaust gas sensor controller are adapted based on the time delay or the time constant.

As yet another embodiment, an engine system includes an engine including a fuel injection system; an exhaust gas sensor coupled to an exhaust passage of the engine, wherein the exhaust sensor has an asymmetric sensor degradation; a controller with computer readable instructions stored on a non-transitory memory configured for: sensing an air-fuel ratio via the sensor; generating a modified air-fuel ratio with symmetric response based on the sensed air-fuel ratio; and adjusting the fuel injection system based on the modified air-fuel ratio. In a first example of the engine system, wherein the controller is further configured for compensating the sensor degradation with an anticipatory controller. A second example of the engine system optionally includes the first example and further includes, wherein the modified air-fuel ratio is fed into the anticipatory controller. A third example of the engine system optionally includes one or more of the first and second examples, and further includes, wherein the controller is further configured for determining a time delay and a time constant by comparing the modified air-fuel ratio and a commanded air-fuel ratio. A fourth example of the engine system optionally includes one or more of the first through third examples, and further includes, wherein the controller is further configured for adapting parameters of the anticipatory controller based on the time delay responsive to a delay type degradation, and adapting parameters of the anticipatory controller based on the time constant responsive to a filter type degradation.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

sensing an air-fuel ratio via an exhaust gas sensor;

determining a first time delay of the sensed air-fuel ratio from a commanded air-fuel ratio when the sensed air-fuel ratio is transitioning in a first direction;

determining a second time delay of the sensed air-fuel ratio from the commanded air-fuel ratio when the sensed air-fuel ratio is transitioning in a second, different direction;

determining an asymmetric sensor response responsive to the first time delay different from the second time delay;

responsive to the asymmetric sensor response, generating a modified air-fuel ratio with symmetric response based on the sensed air-fuel ratio; and adjusting fuel injection based on the modified air-fuel ratio.

2. The method of claim 1, wherein the asymmetric sensor response includes sensor response with different dynamics when the commanded air-fuel ratio transitions in different directions.

3. The method of claim 1, wherein the first time delay is less than the second time delay, and the time delays of the modified air-fuel ratio responsive to the commanded air-fuel ratio transitioning in different directions are the same as the second time delay.

4. The method of claim 1, wherein an averaged air-fuel ratio of the modified air-fuel ratio over time is the same as an averaged air-fuel ratio of the commanded air-fuel ratio over time.

5. The method of claim 1, further comprising determining a type of sensor degradation and a magnitude of sensor degradation based on the sensed air-fuel ratio and the commanded air-fuel ratio, and generating the modified air-fuel ratio based on the type and the magnitude of the sensor degradation.

6. The method of claim 5, further comprising adjusting the fuel injection via an exhaust gas sensor controller, and adapting one or more parameters of the controller responsive to the type of sensor degradation and the magnitude of sensor degradation.

7. The method of claim 6, wherein the exhaust gas sensor controller includes a feedback control routine and a Smith Predictor.

8. The method of claim 6, further comprising adjusting the fuel injection via the adapted exhaust gas controller based on the modified air-fuel ratio.

9. A method comprising:

operating engine components with a commanded air-fuel ratio;

sensing an air-fuel ratio via an exhaust gas sensor;

determining a sensor degradation based on the sensed air-fuel ratio;

modifying an un-faulted portion of the sensed air-fuel ratio responsive to an asymmetric type sensor degradation, wherein the modified air-fuel ratio has a symmetric response; and adjusting a fuel injection based on the modified air-fuel ratio.

10. The method of claim 9, wherein determining the sensor degradation includes determining a time constant and a time delay of the sensed air-fuel ratio with respect to the commanded air-fuel ratio.

11. The method of claim 10, wherein modifying the sensed air-fuel ratio includes delaying the un-faulted portion of the sensed air-fuel ratio, responsive to an asymmetric delay type sensor degradation.

12. The method of claim 10, wherein modifying the sensed air-fuel ratio includes filtering the un-faulted portion of the sensed air-fuel ratio based on the time constant, responsive to an asymmetric filter type sensor degradation.

13. The method of claim 10, further comprising adjusting the fuel injection based on a feedback of a filtered air-fuel ratio modified by an exhaust gas sensor controller, wherein parameters of the exhaust gas sensor controller are adapted based on the sensor degradation.

14. The method of claim 13, wherein the parameters of the exhaust gas sensor controller are adapted based on the time delay or the time constant.

15. An engine system, comprising:

an engine including a fuel injection system;

an exhaust gas sensor coupled to an exhaust passage of the engine, wherein the exhaust sensor has an asymmetric sensor degradation;

a controller with computer readable instructions stored on a non-transitory memory configured for:

sensing an air-fuel ratio via the sensor;

determining a first time delay of the sensed air-fuel ratio from a commanded air-fuel ratio when the sensed air-fuel ratio is transitioning in a first direction;

determining a second time delay of the sensed air-fuel ratio from the commanded air-fuel ratio when the sensed air-fuel ratio is transitioning in a second, different direction;

determining the asymmetric sensor degradation responsive to the first time delay different from the second time delay;

generating a modified air-fuel ratio with a symmetric response based on the sensed air-fuel ratio; and adjusting the fuel injection system based on the modified air-fuel ratio.

16. The engine system of claim 15, wherein the controller is further configured for compensating the asymmetric sensor degradation with an anticipatory controller.

17. The engine system of claim 16, wherein the modified air-fuel ratio is fed into the anticipatory controller.

18. The engine system of claim 16, wherein the controller is further configured for determining a time delay and a time constant by comparing the modified air-fuel ratio and the commanded air-fuel ratio.

19. The engine system of claim 18, wherein the controller is further configured for adapting parameters of the anticipatory controller based on the time delay responsive to a delay type degradation, and adapting parameters of the anticipatory controller based on the time constant responsive to a filter type degradation.

* * * * *